US007290317B2

(12) United States Patent
Kato et al.

(10) Patent No.: US 7,290,317 B2
(45) Date of Patent: Nov. 6, 2007

(54) BLIND RIVET SETTING TOOL

(75) Inventors: Toyoshi Kato, Toyohashi (JP); Yoshiharu Kawasaki, Tokyo (JP); Seidou Murai, Hiratsuka (JP)

(73) Assignees: Newfrey LLC, Newark, DE (US); Nissan Shatai Co., Ltd., Hiratsuka-shi (JP)

( * ) Notice: Subject to any disclaimer, the term of this patent is extended or adjusted under 35 U.S.C. 154(b) by 114 days.

(21) Appl. No.: 11/326,518

(22) Filed: Jan. 6, 2006

(65) Prior Publication Data

US 2006/0174466 A1 Aug. 10, 2006

(30) Foreign Application Priority Data

Jan. 6, 2005 (JP) ..... 2005-001336

(51) Int. Cl.
*B21J 15/28* (2006.01)
*B21D 31/00* (2006.01)

(52) U.S. Cl. ..... 29/243.521; 29/243.522; 29/243.523; 29/243.524; 29/243.525; 72/391.4

(58) Field of Classification Search ..... 72/391.4; 29/243.521, 243.522, 243.524, 243.525, 29/243.526, 243.527, 243.528, 243.529
See application file for complete search history.

(56) References Cited

U.S. PATENT DOCUMENTS

| | | | | |
|---|---|---|---|---|
| 5,661,887 | A * | 9/1997 | Byrne et al. | 29/243.525 |
| 6,418,599 | B2 * | 7/2002 | Suzuki et al. | 72/391.4 |
| 6,532,635 | B1 * | 3/2003 | Gregory | 29/243.523 |
| 7,062,843 | B1 * | 6/2006 | Lin | 29/243.525 |

FOREIGN PATENT DOCUMENTS

| | | | |
|---|---|---|---|
| EP | 1 170 073 | A | 1/2002 |
| GB | 1 333 834 | A | 10/1973 |
| JP | 2000-351042 | A | 12/2000 |
| JP | 2002-18544 | A | 1/2002 |

* cited by examiner

*Primary Examiner*—David B Jones
(74) *Attorney, Agent, or Firm*—Miles & Stockbridge P.C.

(57) ABSTRACT

A blind rivet setting tool has a construction in which a tubular spring-biased handle gripped by an operator moves axially of the tool. An interlock between a trigger lever and the handle prevents operation of the tool until a rivet held by the tool is properly positioned in a hole of a workpiece.

3 Claims, 3 Drawing Sheets

22
21
1
29
30
18
15
16
25
13
23
41
31
39
38
17
17
13
33
14
19
34
37
35
11
11
10

BLIND RIVET SETTING TOOL

CROSS-REFERENCE TO RELATED APPLICATION

This application claims the benefit of Japanese application No. 2005-001336 filed Jan. 6, 2005, incorporated herein by reference.

BACKGROUND OF THE INVENTION

The present invention relates to a blind rivet setting tool and, more specifically, to a blind rivet setting tool that does not allow a riveting operation to be performed unless a blind rivet is properly pressed against a workpiece.

A conventional blind rivet comprises a rivet body and a mandrel and is made of a metal such as aluminum or steel, for example. The rivet body has a hollow sleeve with a flange at one end of the sleeve. The mandrel has a head abutting an opposite end of the sleeve and a shank that extends from the head through the sleeve and projects beyond the flange. A blind rivet has the advantage of being able to be fastened to a workpiece, such as a panel, from one side.

Blind rivets are fastened to workpieces using a blind rivet setting tool. One type of conventional blind rivet setting tool has a jaw in a nose at the tip of the tool to grip the shank of a blind rivet mandrel that is inserted into the nose. After the rivet body protruding from the nose is inserted into a mounting hole in a workpiece, such as a panel, until the flange abuts one side of the workpiece, a trigger on the setting tool is squeezed to actuate a piston pneumatically. The piston has a rod that moves in a hydraulic cylinder to generate hydraulic pressure that pulls the jaw inwardly of the tool. As the head of the mandrel is pulled toward the flange, the sleeve of the rivet body expands, and then the shank of the mandrel breaks off. The expanded portion of the sleeve and the flange embrace the workpiece and fasten the rivet body to the workpiece.

One such blind rivet setting tool has a main body that extends rearwardly from the nose, and has a handle associated with the trigger that extends perpendicularly from the main body to be held by an operator when the tool is in use. When an operator grips the handle and holds the tool over a workpiece at a level above the operator's hips, the gripping hand of the operator is in an unnatural position, making it difficult to hold and operate the tool.

An example of a tool constructed to address this problem is disclosed in Kokai 2002-018544 (Patent Document 1). This tool comprises a nose, a housing extending rearwardly from the nose, and a pneumatic cylinder extending rearwardly from the housing. A hydraulic piston-cylinder device is positioned near the pneumatic cylinder inside the housing. The tool extends straight back from the nose to the pneumatic cylinder. A handle to be gripped by an operator is formed on a housing portion of the tool, and a trigger lever is attached to a portion of the handle. To use the tool to fasten a blind rivet to a workpiece from above the workpiece, the operator grips the handle, and lowers the nose of the tool. When the trigger on the handle is squeezed, compressed air from a supply pipe enters the pneumatic cylinder, hydraulic fluid enters the hydraulic piston-cylinder device, and the rivet is fastened to the workplace.

However, in the blind rivet setting tool described in Patent Document 1, the trigger can be operated even when the flange on the rivet body is not properly pressed against a workpiece, and defective fastening of the rivet body to the workpiece may occur if space remains between the flange and the workpiece.

A blind rivet setting tool disclosed in Kokai 2000-351042 (Patent Document 2) prevents a mandrel from being pulled by the tool when the flange on the rivet body is not pressed against a workpiece, but this tool does not have the advantage of the tool in Patent Document 1, because the handle with the attached trigger is perpendicular to the main body of the tool.

BRIEF DESCRIPTION OF THE INVENTION

An object of the present invention is to provide an improved blind rivet setting tool that solves problems associated with prior art setting tools such as those discussed above.

The present invention provides a blind rivet setting tool that does not have a handle extending perpendicularly from the main body of the tool and that prevents operation of a trigger until a rivet flange is properly pressed against a workpiece.

In an embodiment of the invention, a handle gripped by an operator has a tubular configuration enclosing a housing portion behind the nose of the tool and is arranged so as to be able to move lengthwise of the housing portion. The handle is biased rearwardly (away from the nose) by a spring. A trigger lever is normally locked by a protrusion on the spring-biased handle to prevent operation of the trigger lever until the sleeve of a blind rivet held at the tip of the nose is inserted into a hole in a workpiece and the flange of the sleeve is properly pressed against the workpiece.

When the handle is gripped by an operator, and the sleeve of a blind rivet held at the tip of the nose is inserted into a mounting hole in a workpiece and the flange of the sleeve is brought into full contact with the workpiece, the operator moves the handle axially towards the tip of the nose and thereby unlocks the trigger lever so that it can be moved by the operator. As a result, the rivet body is positioned correctly in the workpiece when the trigger is operated, and riveting defects due to space remaining between the flange and the workpiece do not occur.

BRIEF DESCRIPTION OF THE DRAWINGS

The invention will be further described in conjunction with the accompanying drawings, which illustrate a preferred (best mode) embodiment, and wherein.

DETAILED DESCRIPTION OF THE INVENTION

Figure 1:
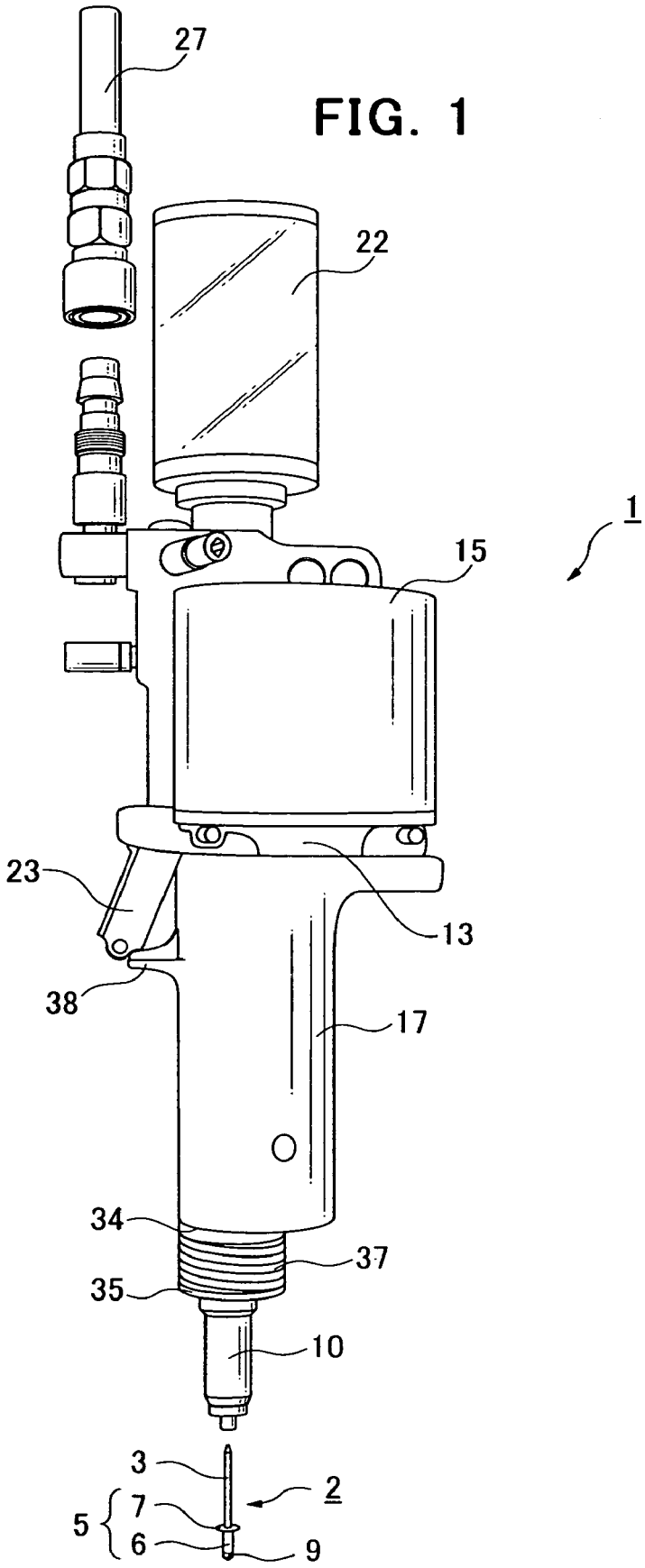
FIG. 1 is a front view of a blind rivet setting tool in an embodiment of the present invention.
Figure 2:
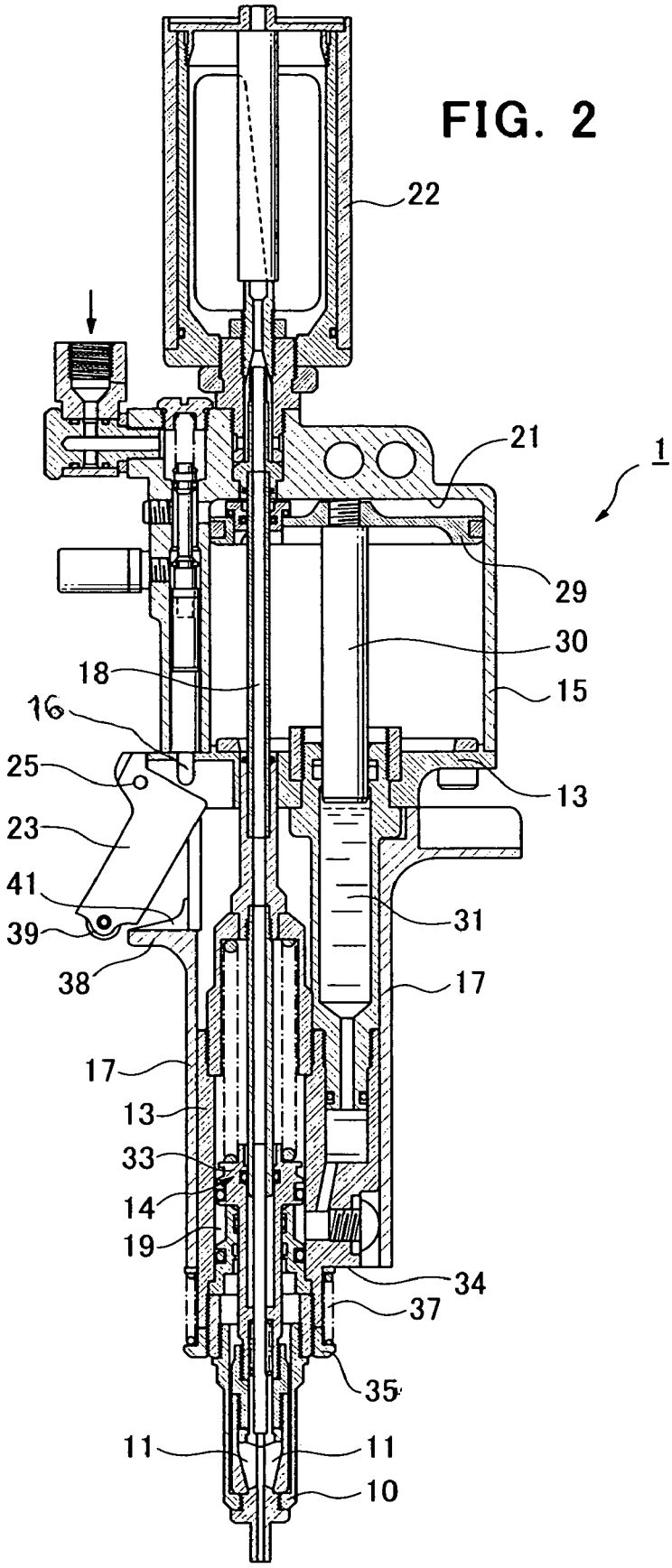
FIG. 2 is a longitudinal sectional view of the setting tool in FIG. 1.

The following is an explanation of an embodiment of the present invention with reference to the drawings. In FIG. 1 and FIG. 2, blind rivet setting tool 1 is shown extending lengthwise vertically to fasten a blind rivet to a workpiece such as a car panel. As shown at the bottom of FIG. 1, the blind rivet 2 includes a mandrel 3 and a rivet body 5. The rivet body 5 has of a sleeve 6 with a flange 7 on one end. The shank of mandrel 3 passes through the rivet body 5 and extends from the flange 7 to be gripped by the rivet setting tool 1. The mandrel head 9, which has a larger diameter than the inner diameter of the sleeve 6, extends from and abuts the sleeve on the end opposite to the flange 7.

As later described, the sleeve 6 of the rivet body 5 is inserted into a mounting hole in a workpiece, and the flange 7 is brought into contact with one side of the workpiece. When the mandrel 3 is pulled strongly toward a break off point, a portion of the sleeve 6 is expanded and deformed by the mandrel head 9. The workpiece is securely interposed between the expansion-deformed portion of the sleeve and the flange 7, and the rivet body 5 is thus fastened to the workpiece. A blind rivet 2 can be fastened to a workpiece with a large area, such as a car panel, from one side.

The rivet setting tool 1 in FIG. 1 and FIG. 2 comprises a hollow nose 10 for receiving the shank of the mandrel 3 of the blind rivet 2, a jaw 11 arranged inside the nose 10 for gripping the shank of the mandrel 3, and piston-cylinder devices 14, 15 arranged in the housing 13 behind the nose 10 and operated to move the jaw 11 rearwardly of the nose. The piston-cylinder devices include a hydraulic piston-cylinder device 14 for strongly pulling the jaw 11 and a pneumatic piston-cylinder device 15 for supplying hydraulic fluid to the hydraulic piston-cylinder device 14. A single piston-cylinder device can be used if it is able to pull the jaw 11 rearwardly of the nose. A handle 17 to be gripped by an operator surrounds a portion of the housing 13. The handle 17 will be explained in detail below.

Pulling of the jaw 11 ultimately breaks the shank of the mandrel and a broken off portion of the mandrel is discharged to the rear of the rivet setting tool 1. As shown in FIG. 2, a discharge path 18 extends to the rear end of the tool via the cylinder 19 in the hydraulic piston-cylinder device 14 inside the housing 13 and the cylinder 21 in the pneumatic piston cylinder device 15. A tubular container 22 for housing broken off mandrel shanks is provided at the outlet of the discharge path 18.

The rivet setting tool 1 is constructed so as to extend straight back from the nose 10 to the piston-cylinder devices at the rear of the housing 13. Because the handle is not perpendicular to the housing 13, the entire tool is compact, lightweight and suitable for being held at a position above an operator's hips to insert and fasten a blind rivet into a workpiece from above.

In order to operate the piston-cylinder devices 14, 15 so as to move the jaw 11 rearwardly of the nose in the rivet setting tool 1, a trigger lever 23 extending from a portion at the rear of the handle 17 (upper portion of FIG. 1 and FIG. 2) is attached pivotally to the housing 13 via a pivot pin 25. When the trigger 23 turns, counterclockwise around the pivot pin 25 in FIG. 2 (see FIG. 4), as later described, a trigger valve pin 26 is pushed up, and compressed air supplied from a hose 27 (FIG. 1) is sent to the cylinder 21 in the pneumatic piston-cylinder device 15. The compressed air pushes the piston 29 down, the piston rod 30 enters a basin 31, hydraulic fluid in the basin is supplied to the cylinder 19 in the hydraulic piston-cylinder device 14, the hydraulic piston 33 moves upward, and the jaw 11 in the nose 10 is forcibly raised. The pneumatic piston-cylinder device 15 is designed to have a multiplier effect on the hydraulic piston-cylinder device 14. The strong force applied to the jaw 11 is transmitted to the mandrel 3 being gripped by the jaw 11, part of the sleeve 6 is deformed and expanded by the mandrel head 9, and the workpiece is securely interposed between the expansion-deformed portion of the sleeve and the flange 7 in order to fasten the rivet body 5 to the workpiece. The strong force applied to the jaw 11 also breaks the shank of mandrel 3, and a broken portion of the mandrel shank passes through the discharge path 18 to the container 22.

The handle 17 gripped by the operator is tubular and surrounds a portion of the housing 13 (and/or the nose 10) so that it can move lengthwise (vertically in FIG. 1 and FIG. 2). The handle 17 is positioned so that the operator can grip it comfortably. Preferably, it should be able to slide not only with respect to the outer periphery of the housing 13 but also with respect to the outer periphery of the nose 10. It can also be positioned so as to straddle the nose 10 and the housing 13.

A coil spring 37 is placed between the front end 34 of the handle 17 (the lower end in the figures) and a ridge at the front end 35 of the housing 13, so that the handle 17 is spring-biased rearwardly behind the nose 10 (toward the upper end of the figures). The spring action of the coil spring 37 is strong enough to prevent the handle 17 from moving forward (downward in the figures) until the flange of a blind rivet held by the nose 10 comes into contact with a workpiece and strong downward pressure is applied by an operator gripping the handle.

Figure 3:
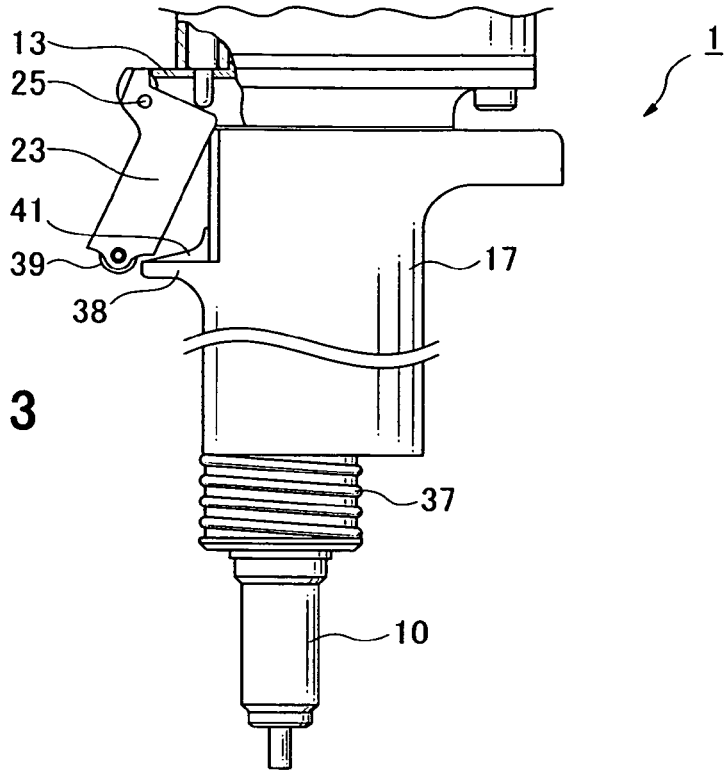
FIG. 3 is a fragmentary front view of the handle and nose portions of the setting tool in FIG. 1 with the trigger lever shown locked in a standby state.

As mentioned earlier, the trigger lever 23 is pivotally connected to the housing 13 via a pivot pin 25. A protrusion 38 is formed on the rear portion of the handle 17 (the upper portion of the figures) to keep the trigger lever 23 from turning around the pivot pin 25. In a standby state the protrusion 38 engages a portion of the trigger lever 23 when the spring action of the coil spring 37 has moved the handle 17 to the rear (upwards in the figures), i.e., when the operator is not pressing the nose 10 (or the flange of a blind rivet held in the nose 10) strongly against a workpiece. When the protrusion 38 engages the trigger lever 23 as shown in FIG. 3, it locks the trigger lever 23 to keep the tool from being operated. In the embodiment, a roller 39 is situated at the free end of the trigger lever 23, and a curved guide 41 is formed on the protrusion 38 for the roller 39, to make the operation of the trigger lever 23 smoother and more comfortable.

Figure 4:
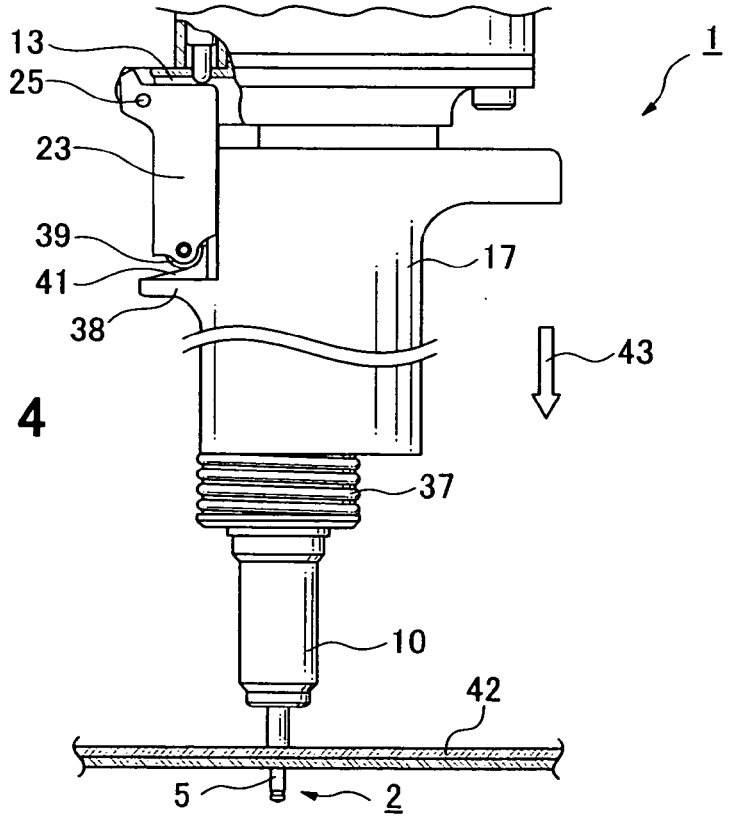
FIG. 4 is a view similar to FIG. 3, with the trigger lever shown unlocked for setting a rivet.

The locking and unlocking of the trigger lever 23 and the fastening of a blind rivet 2 to a workpiece will now be explained with reference to FIG. 3 and FIG. 4. Initially, coil spring 37 applies spring action against the handle 17, that biases the handle 17 towards the rear (upwards in the figure). The protrusion 38 engages the free end of the trigger lever 23 to keep the trigger lever 23 from turning around the pivot pin 25 counterclockwise in the figures, and locks the trigger lever 23. In FIG. 4, the shank of the mandrel in the blind rivet 2 is inserted into and held by the jaw in nose 10. Once the sleeve of the rivet body 5 has been inserted into a mounting hole in a workpiece 42, the operator gripping the handle 17 applies downward pressure in excess of the spring action of the coil spring 37 in the direction of arrow 43 in FIG. 4 so as to press the flange of the rivet body 5 at the tip of the nose 10 strongly against the workpiece 42 to close the gap between the flange on the blind rivet 2 and the workpiece. The strong downward pressure overcomes the spring action of the coil spring 37 and moves the handle 17 towards the tip of the nose 10.

The downward movement of the handle 17 disengages the protrusion 38 from the trigger lever 23 and unlocks the trigger lever. When the operator uses a finger to squeeze the trigger lever 23 to the position shown in FIG. 4, the compressed air supplied from the hose 27 in FIG. 1 is supplied to the cylinder 21 in the pneumatic piston-cylinder device 15 in FIG. 2, pushing the piston 29 down. The piston rod 30 enters the basin 31, the fluid in the basin is supplied to the cylinder 19 in the hydraulic piston-cylinder device 14, the hydraulic piston 33 moves upward, and the jaw 11 in the nose 10 is forcibly raised. The force transmitted to the mandrel 3 being gripped by the jaw 11 causes part of the sleeve 6 to be deformed and expanded by the mandrel head 9, and the workpiece is strongly interposed between the expansion-deformed portion of the sleeve and the flange 7 in order to fasten the rivet body 5 to the workpiece. As a result, the rivet body is positioned correctly in the workpiece. When the amount of downward force applied to the handle does not exceed a predetermined amount of force (exceeding the spring-bias force), the trigger lever cannot be operated. Therefore, the trigger lever cannot be operated until the rivet flange is pressed correctly against the workpiece, and fastening defects due to space remaining between the flange and the workpiece do not occur.

When there is no operator-applied pressure on the handle 17 after a riveting operation has been completed and the trigger lever 23 is released, the trigger lever moves clockwise in the figures to its original position by pressure from pin 26. Clockwise movement is stopped by engagement of cooperable portions of the trigger lever 23 and the housing 13. During the return process, the roller 39 on the trigger lever 23 moves smoothly along the curved guide 41 on the protrusion 38. Return of the trigger lever 23 to its original position can be aided by a trigger lever bias spring or other means (not shown).

While a preferred embodiment of the invention has been shown and described, changes can be made without departing from the principles and spirit of the invention, the scope of which is defined in the following claims.

What is claimed is:

1. A blind rivet setting tool comprising:

a hollow nose for receiving the shank of a mandrel of a blind rivet at a tip of the nose;

means arranged inside the nose for gripping the shank of the mandrel received inside the nose; and a piston-cylinder device arranged in a housing behind the nose and actuated by a trigger lever attached to the housing to pull the gripping means rearwardly of the nose, wherein the pulling of the gripping means deforms and expands a portion of a sleeve of a body of the rivet to fasten the rivet body to the workpiece by means of the expansion-deformed portion of the sleeve and a flange on an end of the sleeve, wherein the tool has a handle gripped by an operator that has a tubular configuration surrounding a portion of the housing and arranged to move lengthwise of the housing, wherein the handle is biased away from the nose by a spring, wherein in a standby state the trigger lever is locked against operation by a protrusion on the handle, and wherein the handle can be moved to unlock the trigger lever when the handle is gripped and moved toward the nose after the sleeve of the blind rivet at the tip of the nose is inserted into a hole in a workpiece and the flange is pressed against the workpiece.

2. The device described in claim 1, wherein one end of the trigger lever is connected pivotally to the housing, wherein in the standby state the protrusion on the handle prevents turning of the trigger lever, and wherein the protrusion is moved to unlock the trigger lever by movement of the handle towards the nose.

3. A blind rivet setting tool that extends lengthwise in an axial direction of a shank of a mandrel of a blind rivet held by the tool at a tip of the tool, and that comprises:

means for gripping the shank of the mandrel; and means for pulling the gripping means in the axial direction away from a body of the rivet, wherein the pulling of the gripping means deforms and expands a portion of a sleeve of the body of the rivet to fasten the rivet body to a workpiece by means of the expansion-deformed portion of the sleeve and a flange on an end of the sleeve, wherein the tool has an operator-held handle arranged to move in the axial direction, and wherein the handle locks the trigger lever in a standby state and unlocks the trigger lever when the handle is moved toward the rivet body in the axial direction.

* * * * *